US006479931B1

(12) United States Patent
Lange et al.

(10) Patent No.: US 6,479,931 B1
(45) Date of Patent: Nov. 12, 2002

(54) EXTENDED TEMPERATURE RANGE FLUORESCENT LAMP

(75) Inventors: Gerhard George Lange, Apalachin, NY (US); Robert Joseph Komar, Owego, NY (US); David Luverne Vos, Apalachin, NY (US)

(73) Assignee: Lockheed Martin Corporation, Rockville, MD (US)

( * ) Notice: Subject to any disclaimer, the term of this patent is extended or adjusted under 35 U.S.C. 154(b) by 956 days.

(21) Appl. No.: 08/658,048

(22) Filed: Jun. 4, 1996

(51) Int. Cl.[7] ..... H01J 61/24; H01J 61/28
(52) U.S. Cl. ..... 313/552; 313/545
(58) Field of Search ..... 313/552, 568, 313/547, 545

(56) References Cited

U.S. PATENT DOCUMENTS

| | | | | |
|---|---|---|---|---|
| 1,897,497 A | | 2/1933 | Pirani | |
| 3,227,907 A | | 1/1966 | Bernier et al. | |
| 3,246,189 A | | 4/1966 | Waymouth | |
| 3,284,664 A | | 11/1966 | Morin et al. | |
| 3,534,212 A | | 10/1970 | Evans | 313/178 |
| 3,617,792 A | | 11/1971 | Lake | 313/185 |
| 3,617,804 A | | 11/1971 | Lake | 313/231 |
| 3,970,957 A | * | 7/1976 | Regan | 315/545 |
| 4,317,061 A | | 2/1982 | Mendelsohn | 313/174 |
| 4,337,414 A | * | 6/1982 | Young | 315/56 |
| 4,627,061 A | * | 12/1986 | McLeod et al. | 313/552 |
| 4,694,215 A | | 9/1987 | Hofmann | 313/44 |
| 5,274,305 A | * | 12/1993 | Bouchard | 315/108 |
| 5,313,562 A | | 5/1994 | Wiltshire | 359/77 |

OTHER PUBLICATIONS

J. Bloem et al., *Some New Mercury Alloys for use in Fluorescent Lamps*, Journal of IES, pp 141–147, Apr. 1977.*

* cited by examiner

*Primary Examiner*—Michael H. Day
(74) *Attorney, Agent, or Firm*—Anthony P. Ng; Bracewell & Patterson, L.L.P.

(57) ABSTRACT

An extended temperature operating range low pressure discharge lamp (10) including: an envelope (12) containing an ionizable medium (20) at a selected pressure; an electrode (16, 18) sealed at each end of the envelope (12) for sustaining an electric discharge through the ionizable medium; and a volume variation control for varying the volume of the ionizable medium (20) in response in variations in temperature within the envelope, wherein the volume variation control includes at least one control volume (of gaseous pressure 40) containing a specified volume of the ionizable medium and an aperture (34) communicating between the envelope (12) and the at least one control volume, wherein the at least one control volume includes a sliding piston (36) for varying the volume of the ionizable medium (20) within the envelope (12).

6 Claims, 4 Drawing Sheets

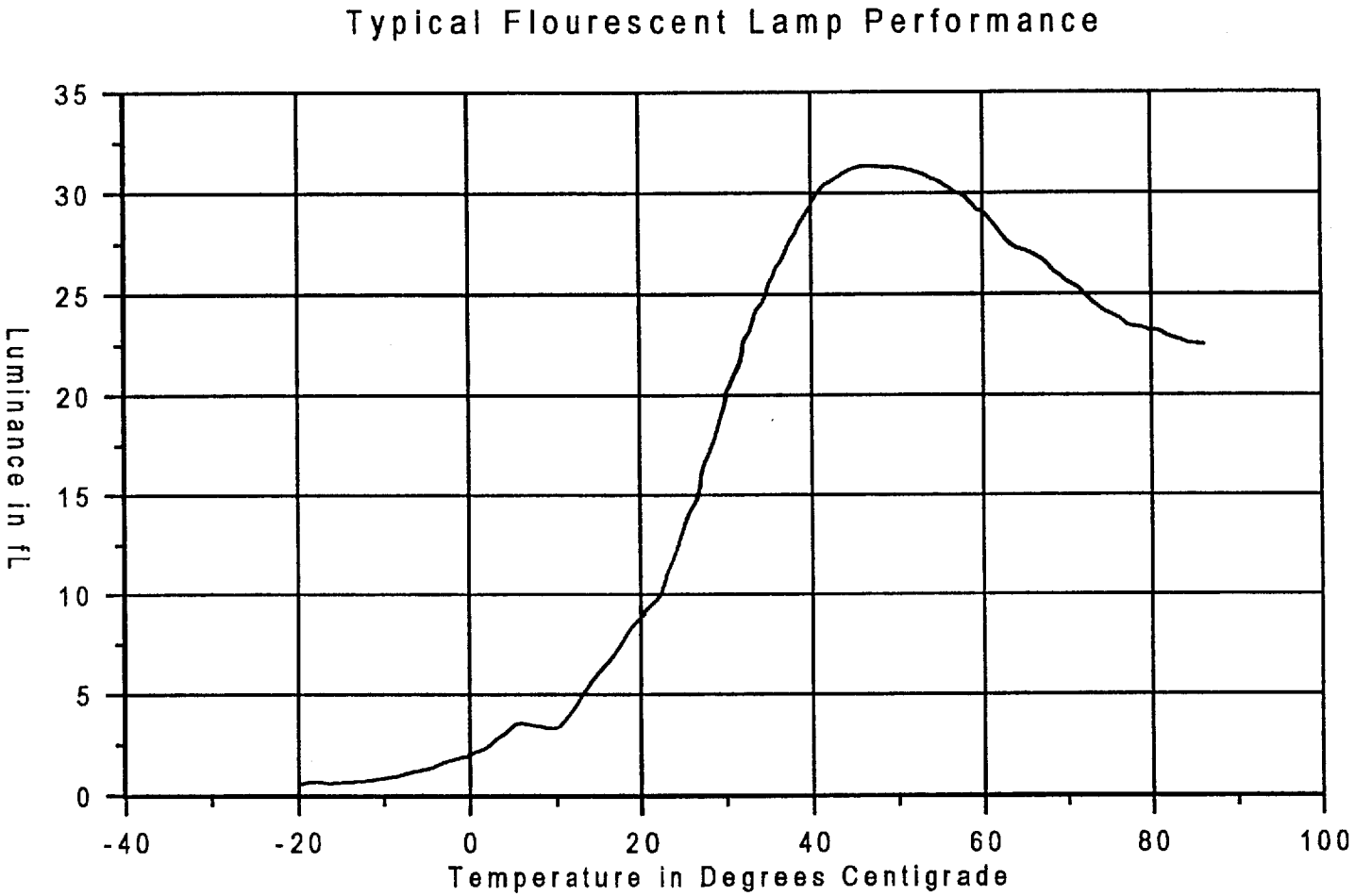
*Fig. 16* *PRIOR ART*

EXTENDED TEMPERATURE RANGE FLUORESCENT LAMP

BACKGROUND OF THE INVENTION

1. Technical Field

The present invention relates in general to an improved fluorescent lamp and in particular to an extended temperature range fluorescent lamp. Still more particularly, the present invention relates to an extended temperature range fluorescent lamp which includes a volume variation control for varying the volume of ionizable medium within the fluorescent lamp in response to temperature variations.

2. Description of the Related Art

Fluorescent lamps, as well known in the prior art, typically comprise a sealed glass envelope containing an ionizable medium, such as neon or argon and a small amount of mercury. An electronic discharge between electrodes at each end of the sealed glass envelope vaporizes and ionizes the mercury and excites the mercury to ultraviolet radiation which, in turn, causes a phosphor to radiate visible light by fluorescence.

It is also well known that the light output of fluorescent lamps is directly dependent upon ambient temperature. This dependence arises from the fact that vapor pressures within a fluorescent lamp depend upon the temperature of the coolest part of the lamp, which in turn depends upon the temperature of the air in which the lamp is operating.

The current state-of-the-art with respect to fluorescent lamps utilizes a constant volume of gas within a tube and the pressure therein will then vary as a function of the ambient temperature. Resultant decreases in light efficiency are caused by pressures which are below the optimum point at low temperatures and pressures which are above the optimum point at high temperatures.

Numerous attempts have been made to compensate fluorescent lamps for changes in ambient temperature. For example, U.S. Pat. No. 3,284,664 teaches pressure regulation of the ionizable medium within a fluorescent lamp by the utilization of Peltier cooling devices, such as thermoelectric junctions. By providing a thermoelectric junction, on the surface of the fluorescent tube, heat may be. added to or subtracted from the fluorescent lamp in order to compensate the lamp for variations in ambient temperature.

U.S. Pat. No. 3,617,792 teaches a fluorescent lamp in which the discharge is confined to an inner vitreous tube within a sealed outer envelope in an effort to stabilize the fluorescence within the lamp. U.S. Pat. No. 3,246,189 teaches the utilization of an auxiliary electrode which is connected to one emissive electrode and located between a wall between the electrodes which provides a chamber for one electrode and forms a passage for electron discharge from one electrode to the other electrode, such that ion flow will be inhibited, thereby raising the vapor pressure of the ionizable material within the chamber to compensate for low ambient temperatures.

Additionally, increases in electrical power applied to such lamps have been proposed for utilization in high temperature environments. However, since the increase in electrical power involves greater power dissipation and further increases the temperature within the fluorescent lamp, a further decrease in efficiency and a possible thermal runaway condition may result.

Fluorescent lamp technology is currently proposed for utilization within flat panel display back light applications because of the high efficiency, uniform distribution and "flat" aspect ratio of such lighting. However, rigorous military and outdoor, rugged environment applications for such flat panel technology require the provision of a fluorescent lamp which provides uniform lighting over an extended temperature range.

It should therefore be apparent that a need exists for an extended temperature range fluorescent lamp.

SUMMARY OF THE INVENTION

It is therefore one object of the present invention to provide an improved fluorescent lamp.

It is another object of the present invention to provide an extended temperature range fluorescent lamp.

It is yet another object of the present invention to provide an extended temperature range fluorescent lamp which includes a volume variation control for varying the volume of ionizable material within the fluorescent lamp in response to ambient temperature variations.

The foregoing objects are achieved as is now described. An extended temperature range fluorescent lamp is provided which includes an envelope which contains an ionizable medium at a selected pressure. An electrode at each end of the envelope is then utilized to sustain an electric discharge through the ionizable medium. Variations in temperature of the fluorescent lamp cause variations in vapor pressure within the envelope and adversely effect the lighting efficiency of the fluorescent lamp. A volume variation control is provided which varies the volume of the ionizable medium within the envelope in response to temperature variations, such that a selected pressure can be maintained. Volume variation is accomplished by providing a flexible mechanical interface-to the envelope or by coupling one or more control volumes of ionizable medium to the envelope and selectively varying the volume of ionizable medium within the envelope in response to temperature variations.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1*b* is a graph depicting the interdependence of light efficiency and temperature;

DETAILED DESCRIPTION OF PREFERRED EMBODIMENT

Figure 1A:
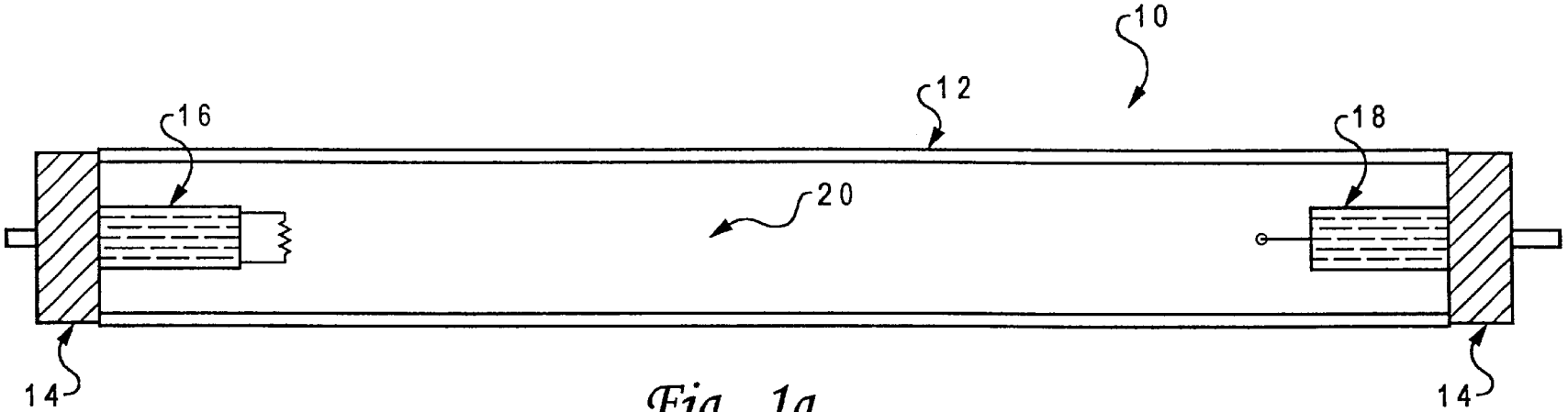
Fig. 1a Prior Art
FIG. 1*a* is a side sectional view of a prior art fluorescent lamp.

With reference now to the figures and in particular with reference to FIG. 1*a*, there is depicted a side sectional view of a prior art fluorescent lamp 10. As depicted, fluorescent lamp 10 includes an envelope 12, typically formed of glass. Additionally, a seal 14 is provided at each end of envelope 12. A pair of opposed electrodes 16 and 18 are also provided and utilized, in a manner well known to those having ordinary skill in the art, to sustain an electric discharge through ionizable medium 20 within envelope 12. As described above, increases in ambient temperature will result in an increased vapor pressure within envelope 12 and a concomitant decrease in the lighting efficiency of fluorescent lamp 10, as illustrated in the graph depicted in FIG. 1*b*. Similarly, a decrease in ambient temperature can result in a decrease in the vapor pressure of ionizable medium 20 within envelope 12 and also decrease the lighting efficacy of fluorescent lamp 10.

Figure 2:
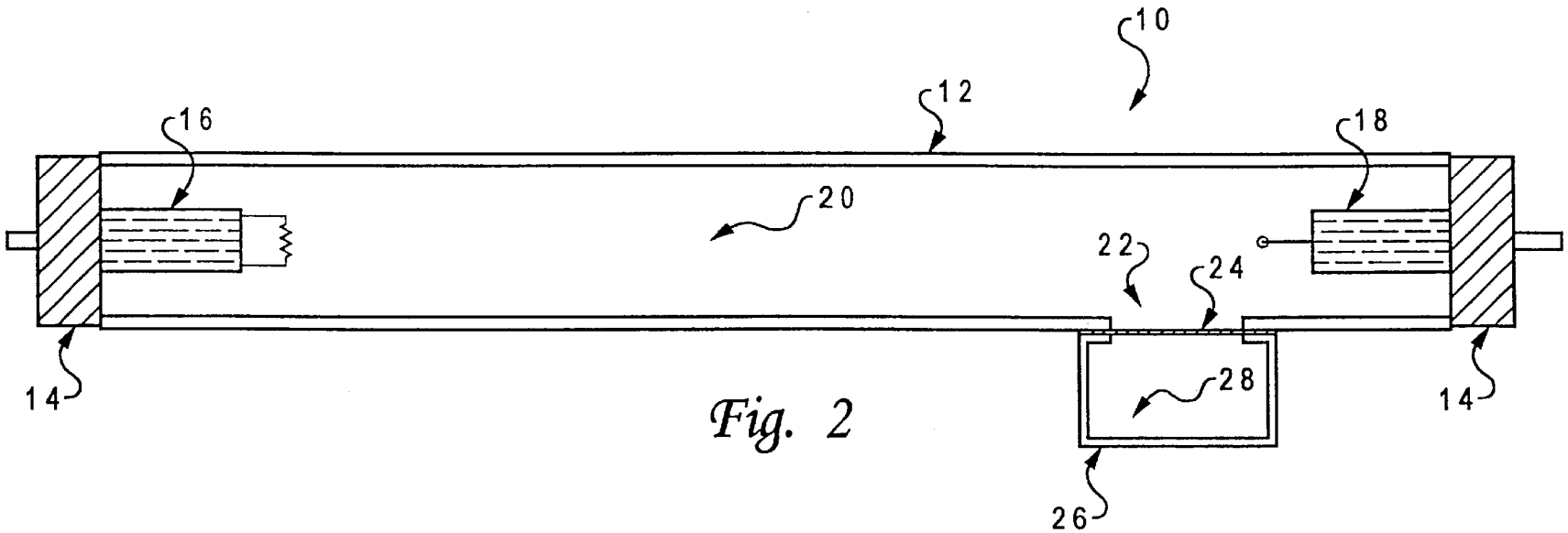
FIG. 2 is a partially schematic side view of a first embodiment of the novel extended temperature range fluorescent lamp of the present invention.

Referring now to FIG. 2, there is depicted a partially schematic side view of a first embodiment of a novel extended temperature range fluorescent lamp provided in accordance with the present invention. For purposes of illustration, in each of the described embodiments of the present invention, those elements which are identical to the elements within the prior art fluorescent lamp of FIG. 1 will be described utilizing identical reference numerals.

Still referring to FIG. 2, as illustrated, fluorescent lamp 10 comprises an envelope 12 which is sealed at each end. Electrodes 16 and 18 are utilized to sustain an electric discharge through ionizable medium 20.

In accordance with an important feature of the present invention an aperture 22 is provided within envelope 12. One side of a flexible mechanical interface 24 is then utilized to cover aperture 22 and the opposite side of flexible mechanical interface 24 is then utilized to cover an aperture within control volume 26. Control volume 26 may be a simple passive, evacuated volume having no reactionary force against flexible mechanical interface 24. Alternatively, control volume 26 may be filled with a gas 28 having vapor pressure which is actively controlled utilizing a small thermoelectric heat pump to provide both positive and negative temperature control. Flexible mechanical interface 24 may be constructed of any suitable flexible material such as a polyimide film, metal or ceramics, depending upon the desired operating temperature range.

In the manner described above with respect to FIG. 2, an increase in the vapor pressure of ionizable medium 20 within envelope 12 will result in a distention of flexible mechanical interface 24 into control volume 26 and a concomitant decrease in the vapor pressure within envelope 12. Conversely, a decrease in the vapor pressure of ionizable medium 20 within envelope 12 will result in a distention of flexible mechanical interface 24 into envelope 12, increasing the vapor pressure present therein. In this manner the vapor pressure of ionizable medium 20 within envelope 12 may be controlled by varying the volume of ionizable medium 20 within envelope 12.

Figure 3:
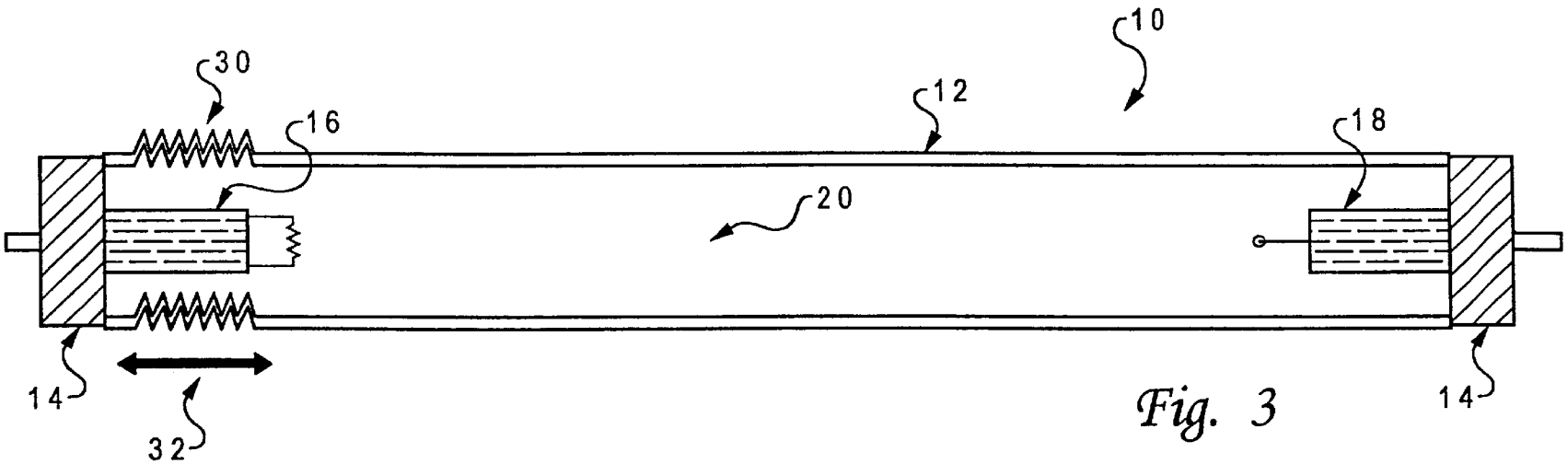
FIG. 3 is a partially schematic side view of a second embodiment of the novel extended temperature range fluorescent lamp of the present invention.

With reference now to FIG. 3, there is depicted a partially schematic side view of a second embodiment of the novel extended temperature range fluorescent lamp of the present invention. As depicted within FIG. 3, fluorescent lamp 10 includes an envelope 12 capped at each end, in the manner described above. However, as an additional feature of the embodiment of FIG. 3, an expansion joint 30 is provided on at least one end of envelope 12. Expansion joint 30 may form a separate member from seal 14 or, in an alternate embodiment of the present invention, may be provided integrally within seal 14.

As illustrated at arrow 32, an increase in the vapor pressure of ionizable medium 20 within envelope 12 caused by an increase in the ambient temperature will result in an expansion of envelope 12 toward the near seal 14, increasing the volume of ionizable medium 20 and decreasing the vapor pressure therein. Similarly, a decrease in the vapor pressure of ionizable medium 20 within envelope 12 will result in a contraction of expansion joint 30 and a decrease in the volume of ionizable medium within envelope 12.

In this manner, as depicted within FIGS. 2 or 3, the provision of a flexible mechanical interface within the envelope can be utilized to simply and efficiently control the volume of ionizable medium within the envelope to compensate for variations in vapor pressure therein brought about by changes in ambient temperature.

Figure 4:
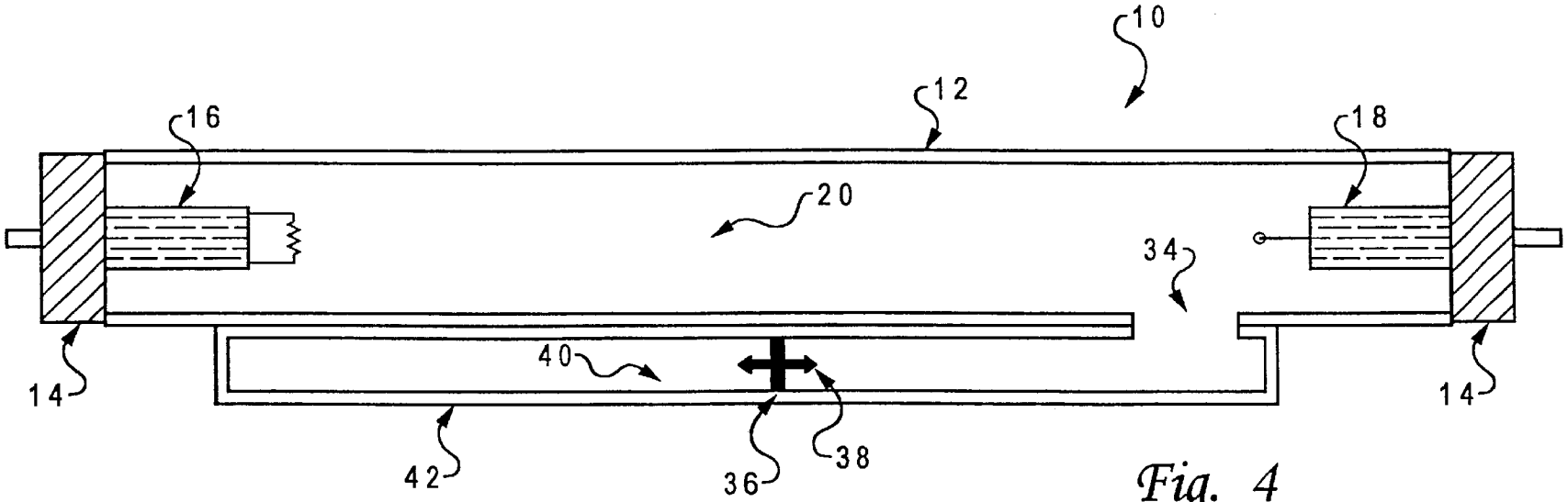
FIG. 4 is a partially schematic side view of a third embodiment of the novel extended temperature range fluorescent lamp of the present invention.

Referring now to FIG. 4, there is depicted a partially schematic side view of a third embodiment of the novel extended temperature range fluorescent lamp of the present invention. As illustrated within FIG. 4, an aperture 34 is provided from envelope 12 which communicates with control volume piston 42. A movable piston 36 is provided within control volume piston 42 and moves longitudinally, in the directions indicated at arrow 38. A control volume of gaseous pressure 40 is provided within control volume piston 42 and variations in the vapor pressure of ionizable medium 20 within envelope 12, which communicate through aperture 34 into control volume piston 42, will result in a movement of piston 36 in a longitudinal manner within control volume piston 42.

Thus, increases in the vapor pressure of ionizable medium 20 within envelope 12 will be communicated via aperture 34 into control volume piston 42 and cause a movement of piston 36 in a left-ward direction, increasing the volume of ionizable medium within envelope 12 and decreasing the vapor pressure to the desired pressure level. Conversely, decreases in vapor pressure of ionizable medium 20 within envelope 12 will be communicated via aperture 34 into control volume piston 42 and will result in a movement of piston 36 to the right, urged by the pressure of control volume 40, decreasing the volume of ionizable medium 20 within envelope 12 and raising the vapor pressure to the desire level.

In this manner, variations in the volume of ionizable medium within envelope 12 can be created to compensate fluorescent lamp 10 for vapor pressure variations within the ionizable medium brought about by changes in ambient temperature.

Figure 5:
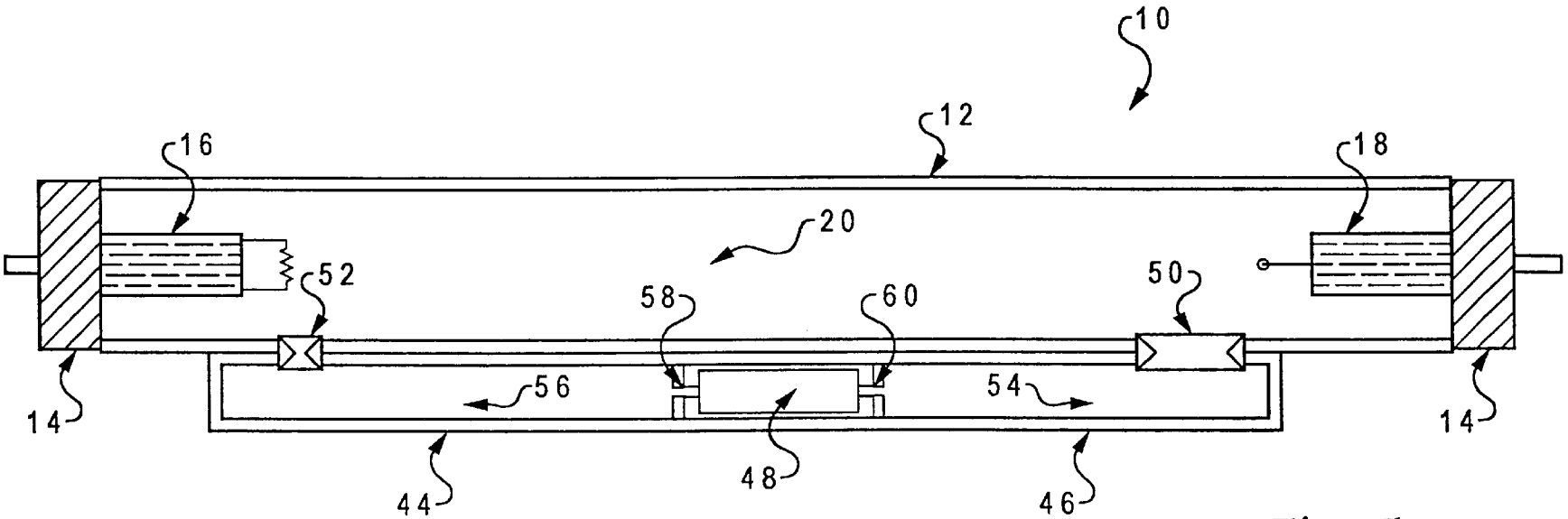
FIG. 5 is a partially schematic side view of a fourth embodiment of the novel extended temperature range fluorescent lamp of the present invention.

Finally, with reference to FIG. 5, there is depicted a partially schematic side view of a fourth embodiment of the novel extended temperature range fluorescent lamp of the present invention. As depicted within FIG. 5, a plurality of control volumes are coupled to fluorescent lamp 10. A low pressure control volume 44 is provided which encases a volume of ionizable medium 56 at a pressure lower than the desired pressure of ionizable medium 20 within envelope 12. Conversely, a high pressure control volume 46 is provided which encloses a volume of ionizable medium 54 which is at a higher pressure than the desired pressure of ionizable medium 20 within envelope 12. A regenerative pump 48 is also provided which includes an inlet valve 58 coupled to low pressure control volume 44 and a discharge valve 60 coupled to high pressure control volume 46. Regenerative pump 48 and valves 58 and 60 may be implemented utilizing any well known micromechanical device currently available.

In accordance with an important feature of this embodiment, an inlet valve 50 is provided which permits high pressure ionizable medium 54 within high pressure control volume 46 to enter envelope 12 and join ionizable medium 20 therein. Similarly, a bleed valve 52 is provided which permits ionizable medium 20 within envelope 12 to leave envelope 12 and enter low pressure control volume 44, joining ionizable medium 56 therein.

The variation in vapor pressure within low pressure volume 44 and high pressure control volume 46 is maintained utilizing regenerative pump 48 which evacuates ionizable medium 56 from low pressure control volume 44 and discharges that ionizable medium into high pressure control volume 46. Thus, an increase in ambient temperature surrounding fluorescent lamp 10 which results in an increase in the vapor pressure of ionizable medium 20 within envelope 12 will result in ionizable medium 20 being discharged through bleed valve 52 into low pressure control volume 44. Conversely, a decrease in the vapor pressure of ionizable medium 20 within envelope 12 will result in a discharge of ionizable medium 54 from high pressure control volume 46 through inlet valve 50 into envelope 12. In this manner, the desired vapor pressure of ionizable medium 20 within envelope 12 may be maintained with great accuracy, resulting in a fluorescent lamp having a substantially extended temperature range.

Upon reference to the foregoing those skilled in the art will appreciate that the Applicants herein have provided a novel technique whereby the vapor pressure of an ionizable medium within a fluorescent lamp may be accurately controlled by varying the volume of that ionizable medium in order to maintain the desired vapor pressure within the fluorescent lamp for optimum lighting efficiency.

While the invention has been particularly shown and described with reference to a preferred embodiment, it will be understood by those skilled in the art that various changes in form and detail may be made therein without departing from the spirit and scope of the invention.

What is claimed is:

1. An extended temperature operating range low pressure discharge lamp comprising:

an envelope containing an ionizable medium at a selected pressure;

an electrode sealed at each end of said envelope for sustaining an electric discharge through said ionizable medium;

a volume variation control for varying the volume of said ionizable medium within said envelope in response to variations in temperature within said envelope, wherein said selected pressure may be maintained within said envelope over an extended temperature range, wherein said volume variation control includes at least one control volume containing a specified volume of said ionizable medium and an aperture communicating between said envelope and said at least one control volume, wherein said at least one control volume includes a sliding piston for varying the volume of said ionizable medium within said envelope in response to movement thereof.

2. The extended temperature operating range low pressure discharge lamp according to claim 1, wherein said volume variation control comprises a low pressure control volume containing a volume of said ionizable medium at a pressure below said selected pressure, and a high pressure control volume containing a volume of said ionizable medium at a pressure above said selected pressure.

3. The extended temperature operating range low pressure discharge lamp according to claim 2, further including a bleed valve communicating between said envelope and said low pressure control volume.

4. The extended temperature operating range low pressure discharge lamp according to claim 3, further including an inlet valve communicating between said envelope and said high pressure control volume.

5. The extended temperature operating range low pressure discharge lamp according to claim 4, wherein said inlet valve passes a portion of said ionizable medium from said high pressure control volume to said envelope in response to a pressure within said envelope which is below said selected pressure.

6. The extended temperature operating range low pressure discharge lamp according to claim 3, wherein said bleed valve passes a portion of said ionizable medium from said envelope to said low pressure control volume in response to a pressure within said envelope in excess of said selected pressure.

* * * * *